United States Patent [19]

Baker et al.

[11] Patent Number: 4,925,505

[45] Date of Patent: May 15, 1990

[54] FOAMED NITROPARAFFIN EXPLOSIVE COMPOSITION

[75] Inventors: Mark A. Baker, Hudson Heights; C. John Anderson, Kingston, both of Canada

[73] Assignee: Her Majesty the Queen in Right of Canada as represented by the Minister of National Defence, Ottawa, Canada

[21] Appl. No.: 352,336

[22] Filed: May 16, 1989

[30] Foreign Application Priority Data

Aug. 10, 1988 [CA] Canada ..... 574385

[51] Int. Cl.[5] ..... C06B 25/36

[52] U.S. Cl. ..... 149/89

[58] Field of Search ..... 149/89

[56] References Cited

U.S. PATENT DOCUMENTS

| | | | |
|---|---|---|---|
| 2,967,099 | 1/1961 | Pool et al. | 149/89 |
| 3,419,444 | 12/1968 | Minnick | 149/89 |
| 3,713,915 | 1/1973 | Fast | 149/89 |
| 3,797,392 | 3/1974 | Eckels | 149/89 |
| 4,038,112 | 7/1977 | Asaoka | 149/89 |
| 4,076,562 | 2/1978 | Forsythe | 149/89 |
| 4,317,691 | 3/1982 | Katsuta et al. | 149/89 |
| 4,326,900 | 4/1982 | Hattori et al. | 149/89 |

*Primary Examiner*—Edward A. Miller

*Attorney, Agent, or Firm*—Nixon & Vanderhye

[57] ABSTRACT

The invention disclosed is a foamable fluid explosive composition which is capable of being projected over suspect terrain to form a continuous blanket of explosive foam which may be detonated by conventional means. The novel fluid explosive composition comprises

| | |
|---|---|
| a suitable liquid foamable explosive | 57–98%/w |
| a suitable liquid emulsifier | 2–6%/w |
| a suitable stabilizer | 0–5%/w |
| a suitable thickener | 0–7%/w |
| a sensitizer | 0–5%/w |
| energy enhancer/inert metals | 0–20%/w |

wherein the amounts of ingredients are expressed as percent by weight of the composition, excepting the sensitizer which is expressed as percent by weight of the explosive. The same fluid explosive composition is adapted for aerosol delivery by including a suitable compressed liquified gas as propellant.

24 Claims, No Drawings

FOAMED NITROPARAFFIN EXPLOSIVE COMPOSITION

This invention relates to explosives and in particular to an improved foamable explosive composition for use in the detonation of land mines.

Foam-producing explosive compositions are capable of being projected over suspect terrain to form a continuous blanket of explosive foam which on detonation by conventional means (blasting caps and/or priming charges) will activate and destroy buried land mines.

One such form-producing explosive composition is described in U.S. Pat. No. 2967,099 of June 3, 1961 in the name of John E. Pool. Pool's composition includes a foamable liquid explosive such as nitromethane, a solid foaming agent/surfactant e.g. zinc stearate and where applicable, a stabilizing agent (the foaming agent and stabilizer may be one and the same material) to prolong the life of the foam, and a sensitizer, e.g. ethylene diamine, which is incorporated at the time of use. The materials are mixed to form a solid/liquid colloidal dispersion. Air is injected with a perforated mixing paddle to form the foam which can then be projected to produce the explosive blanket.

Among the drawbacks of Pool's composition is the essential inclusion of caustic sensitizers. Pool's foams also exhibit considerable instability as indicated by drainage, i.e. Pool's foam exhibits a drainage rate of approximately 1%–3% per minute (volume %) liquid nitromethane. For example, the formulation in Example 20 exhibits approximately 25% drainage in 5 minutes.

According to our invention, a foamable fluid explosive composition is contemplated, comprising

| | |
|---|---|
| a suitable liquid foamable explosive | 57–98%/w |
| a suitable liquid emulsifier | 2–6%/w |
| a suitable stabilizer | 0–5%/w |
| a suitable thickener | 0–7%/w |
| a sensitizer | 0–5%/w |
| energy enhancer/inert metals | 0–20%/w |

wherein the amounts of ingredients are expressed as percent by weight of the composition, excepting the sensitizer which is expressed as percent by weight of the explosive.

The foamable fluid explosive composition according to our invention is adapted for aerosol delivery by including a suitable compressed liquified gas as propellant. The suitable liquid foamable explosive is preferably a nitroparaffin such as nitromethane, nitroethane, 1-nitropropane, 2-nitropropane and mixtures thereof. Nitromethane is preferred.

The liquid emulsifier is typically a long chain hydrocarbon with polar head groups such as long chain alcohols, e.g. poly-loweralkoxylated alcohols. Polyethoxylated stearyl alcohols are preferred.

A stabilizer may be included to improve the strength of propellant/explosive interfaces, reducing drainage and increasing stability of the resulting foam at higher atmospheric temperatures. Long chain aliphatic alcohols, such as octadecanol are preferred.

A suitable thickener may also be included to stabilize the foam (i.e. drainage is minimized to the order to about 0.5% after 24 h). At higher temperatures stabilizers and thickeners act together to maintain foam quality. For example, small weight percentages of thickener increase viscosity and thus further improve the stability of the foam at higher atmospheric temperatures. Fumed silica is employed for increased density foams. Nitrocellulose, cellulose acetate and modified guar gum Methocel®-331 of Dow Chemical provide suitable low density foams. Another advantage of increasing the viscosity of the liquid phase is that expansion of the foam is slowed, improving projection qualities.

Although a sensitizer is not required except in the case of very low density foams, the shock initiation sensitivity of the nitroparaffin explosive may be increased by introducing strong acids, bases or amines. Organic amines, such as ethylene diamine, diethylene triamine, and triethylene tetramine are sensitizers which may be added to the composition in an amount of three to five percent by weight based upon the weight of the explosive. Tests of our compositions without sensitizers also yield detonations of nitromethane foams indicating that the physical nature of the foams, or other ingredients sensitize the foam. This increased shock sensitivity may be due to density discontinuities resulting from the foam bubble/liquid structure or the suspension of particulates in the foam. For low density foams, i.e. below about 0.15 g/cc sensitizer is required. However, it is most advantageous to eliminate the sensitizer in view of the caustic nature of these materials.

The foamable fluid explosive composition according to the invention is adapted for aerosol delivery by enclosure in a suitable aerosol delivery container and including a suitable compressed liquified gas as propellant. The liquified gas forms with the liquid explosive a substantially stable liquid/liquid emulsion which is held together by the emulsifier, i.e. the emulsifier according to applicant's invention enables the liquified gas propellant to be uniformly dispersed throughout the liquid explosive as tiny droplets of substantially uniform size. Typical suitable liquified gases include propane, butane, $CO_2$, propylene, and halocarbons, e.g. chlorofluorocarbons.

The compressed liquified gas is included in the composition in an amount of 1–20 %/w.

Explosive energy enhancers and/or inert metals may also be included, i.e. in amounts of 0–20 %/w. Energetic metallic additives, such as finely divided aluminum, can increase the overall energy release of explosives by reacting with the detonation products to liberate additional energy. Other effects include increasing density which increases the velocity of detonation, but usually decreases shock sensitivity. With the nitromethane foam, an increase in sensitivity is observed when powdered energetic metals were added. This is probably because the metal particles act as density discontinuities and provide reaction centres, thus increasing the sensitivity.

Inert metal loading of explosives can, in theory, flatten the pressure profile of the detonation wave and result in a longer detonation impulse. The inert metals employed to provide this effect are generally finely divided lead or copper metal. These metals are also employed to successfully increase the density of the final foam product.

The foamable explosive composition according to the invention is made as follows. The foamable explosives can be made with varying quantities of each additive within the ranges described above. Converted fire extinguishers have been used as the aerosol containers. When all the desired components are combined in the cylinder, only a brief shaking is required to form the emulsion. Controlled discharge immediately following the mixing results in the formation of a stable foam.

A nitromethane concentrate (i.e. the nitroparaffin explosive, the emulsifier, the stabilizer, if present, and the thickeners, if present) is the main component and is added first to the discharge cylinder. The desired density and thickness of the foam blanket determine if sensitizers are required. Energy enhancers and inert metals are also optional. If a sensitizer is to be incorporated then it is added prior to the liquified gas component. Vapour pressure can be used to force the liquified gas into the sealed container through a valve assembly.

At ambient room temperature, a 20 pound fire extinguisher with an 18 inch long by ⅝ inch diameter discharge tube was used to provide dispersals of distances over 25 feet. The projected foam remained intact, and showed minimal collapse from impact with the target area. The foam was subsequently detonated to yield surface pressures and impules greater than 100 atmospheres (atm) and 100 atmosphere-milliseconds (atm-ms) respectively.

The appearance of the various foams range from slowly collapsing wet foams, to very dry rigid structures with air spaces between layers when the foams are discharged in linear sections. Most foams have qualities lying between these limits. The appearance is generally a slightly moist texture, with flow exhibited to the extent that air gaps are mostly filled. The foams exhibit little collapse when handled or projected. Density and thickness of the resulting foam blanket can be controlled to produce sufficient pressure and impulse when detonated to actuate mines either mechanically or by sympathetic detonation of the explosives they contain.

Densities of the stable, detonating foams have ranged from 0.07 grams per cubic centimeter (g/cc) to 0.50 g/cc. At densities below about 0.15 g/cc sensitizer must be incorporated. Foam density is controlled by varying the amount of added liquified gas. This is dependent to some degree on temperature, due to the increased expansion of these gases with temperature. The solid stabilizers/thickeners also effect the density of the foam to a certain extent, in that the inclusion of these compounds stabilizes the foam structure. This allows stable higher density foams to be formed, depending on the amount of added propane.

Minimum thickness values for sheet charges range from over 7 cm at a density of 0.07 g/cc to 1.3 cm for foam densities over 0.25 g/cc.

Stable nitromethane based foams are produced at temperatures ranging from −40° C. to +40° C. The foam retains its qualities longer at lower temperatures. In laboratory time trials, foams remain stable several days at room temperature. Foams have been successfully detonated during periods of rain. However, under such conditions the time between discharge and detonation must be minimized, otherwise the foam will eventually dissolve. The foams can also be dispersed over uneven terrain and detonated.

Initiation requirements of the foams depend on a variety of factors including: cross sectional area of the charge, density of the foam, and the quantity and type of reactive and unreactive ingredients. For example, a number 8 blasting cap will detonate unsensitized foams of density over 0.20 g/cc. This ranges up to 20 grams of high explosive for sensitized foams of density of 0.10 g/cc.

If additional high explosives are also included in the foam, the foams are cap sensitive at densities as low as 0.10 g/cc. For example, this sensitivity was obtained when 7% PETN was added to the nitromethane foam.

Metallic energizer additions do not affect the minimum primer requirements at the densities attainable with up to 15% metal content by weight, even though critical thickness is reduced.

An example is a foam with 10% aluminum by weight at a density of 0.23 g/cc and 5 cm thickness, which was detonated when initiated by a number 8 detonator. These limits were obtained for unconfined sheet charges.

Detonation properties are dependent on foam composition, density, thickness or diameter, and degree of confinement. Detonation state properties such as velocity of detonation and detonation pressure for various nitromethane foams are almost linear from 0.10 to 0.50 g/cc. Velocities of detonation at these densities range from 1900 metres per second (m/s) to 3200 m/s. Associated detonation pressures are 1500 atmospheres to 15,000 atmospheres.

EXAMPLE 1

| | Weight Percent |
|---|---|
| Nitromethane | 86 |
| Ethylene Diamine | 4 |
| Polyethoxylated Stearyl Alcohol | 3 |
| Octadecanol | 2 |
| Propane (liquified) | 5 |

wherein the amount of ingredients are expressed as percent by weight of the composition, excepting the sensitizer which is expressed as percent by weight of the explosive.

This formulation exhibited a foam density of 0.14 g/cc. The quality was good with no drainage or collapse of the foam. It was detonated in a sheet charge configuration of 20 cm by 76 cm by 7.6 cm, using a detonating charge of 100 grams of high explosive. The detonation velocity was 2800 m/s. Theoretical detonation velocity and pressure for this product are 2790 m/s and 3920 atm.

Another foam, having similar composition and density, was tested using a 5 cm thick sheet charge placed over buried pressure gauges at depths of 5.0 and 10.0 cm. Pressure and impulse readings at 5.0 cm were 1700 atm and 85 atm-ms; at 10.0 cm they were 190 atm and 25 atm-ms.

A similar foam at a density of 0.14 g/cc, but with a thickness of 7.6 cm, yielded pressure and impulse readings at 7.6 cm of 2090 atm and 130 atm-ms. These data illustrate the effect of charge thickness on blast effect.

EXAMPLE 2

| | Weight Percent |
|---|---|
| Nitromethane | 78.0 |
| Nitrocellulose | 1.4 |
| Polyethoxylated Stearyl Alcohol | 3.6 |
| Octadecanol | 2.3 |
| Propane (liquified) | 5.5 |
| Aluminum Powder | 9.2 |

Foam density was 0.15 g/cc. Sheet charge thickness was 5.0 cm. The measured detonation velocity was 2000 m/s. Pressure and impulse measurements at a 10.0 cm depth were 500 atm and 100 atm-ms respectively. Comparing this to the firings without aluminum shows the increased blast effect due this additive. The reduced velocity of detonation is due to the aluminum and the reduced nitromethane contents.

EXAMPLE 3

| | Weight Percent |
|---|---|
| Nitromethane | 91.3 |
| Fumed Silica | 3.5 |
| Polyethoxylated Stearyl Alcohol | 4.0 |
| Propane (liquified) | 1.2 |

This formulation exhibits a foam density of 0.40 g/cc, with minimal drainage or collapse of the foam. A 5 cm sheet of foam was detonated with a #8 electric blasting cap. The measured detonation velocity was 3200 m/s, compared to a theoretical detonation velocity of 3500 m/s.

One advantage of basing this foamed explosive on nitromethane is that this material is currently classed as a flammable liquid for transportation. The liquified gas is of similar transportation status, and other gaseous materials as described above could replace it if problems arose.

It will be appreciated that the aerosol dispersal techniques could be augmented by bulk discharge systems to provide continuous foam production by using separate pumps and storage compartments for the different components, i.e. the liquid concentrate, the sensitizer and the propellant.

It will also be appreciated by those skilled in the art that an invention may be embodied in forms other than those specifically described in the examples. Accordingly, the examples are to be considered as illustrative and by no means restrictive of the scope of applicant's invention.

The embodiments of the invention in which an exclusive property or privilege is claimed are defined as follows:

1. A foamable fluid explosive composition, comprising

| | |
|---|---|
| a suitable liquid foamable explosive | 57–98%/w |
| a suitable liquid emulsifier | 2–6%/w |
| a suitable stabilizer | 0–5%/w |
| a suitable thickener | 0–7%/w |
| a sensitizer | 0–5%/w |
| energy enhancer/inert metals | 0–20%/w |

wherein the amounts of ingredients are expressed as percent by weight of the composition, excepting the sensitizer which is expressed as percent by weight of the explosive.

2. A composition according to claim 1, wherein the explosive is a nitroparaffin selected from the group consisting of nitromethane, nitroethane, 1-nitropropane, 2-nitropropane and mixtures thereof.

3. A composition according to claim 2, wherein the emulsifier is a long chain hydrocarbon with polar head groups.

4. A composition according to claim 3, wherein the stabilizer, if present, is a long chain aliphatic alcohol.

5. A composition according to claim 4, wherein the thickener, if present, is selected from the group consisting of fumed silica, nitrocellulose, cellulose acetate and modified guar gum.

6. A composition according to claim 5, wherein the sensitizer, if present, is selected from the group consisting of strong acids, strong bases and amines.

7. A composition according to claim 6, wherein the energy enhancer, if present, is a finely divided energetic metal.

8. A composition according to claim 7, wherein the inert metal, if present, is selected from the group consisting of finely divided lead and finely divided copper.

9. A composition according to claim 8, wherein the composition additionally comprises 1–20% by weight based on the weight of the composition of a compressed liquified gas selected from the group consisting of propane, butane, propylene, carbon dioxide and chlorofluorocarbons.

10. A composition according to claim 9, wherein the nitroparaffin is nitromethane.

11. A composition according to claim 10, wherein the emulsifier, if present, is a poly-loweralkoxylated alcohol.

12. A composition according to claim 11, wherein the emsulifier, if present, is a polyethoxylated stearyl alcohol.

13. A composition according to claim 12, wherein the stabilizer, if present, is octadecanol.

14. A composition according to claim 13, wherein the sensitizer, if present, is an organic amine selected from the group consisting of ethylene diamine, diethylene triamine and triethylene tetramine.

15. A composition according to claim 14, wherein the energetic metal, if present, is aluminum.

16. A composition according to claim 15, wherein the thickener, if present, is fumed silica.

17. A composition according to claim 15, wherein the thickener, if present, is nitrocellulose.

18. A composition according to claim 16, wherein the liquified gas is propane.

19. A composition according to claim 17, wherein the liquified gas is propane.

20. A composition according to claim 9, wherein the density of the resulting foam is from 0.07–0.50 g/cc.

21. A composition according to claim 9, wherein the density of the resulting foam is from 0.14–0.40 g/cc.

22. A foamable fluid explosive composition, comprising

| | Weight Percent |
|---|---|
| Nitromethane | 86 |
| polyethoxylated stearyl alcohol | 3 |
| octadecanol | 2 |
| ethylene diamine | 4 |
| propane (liquified) | 5 |

wherein the amounts of ingredients are expressed as percent by weight of the composition, excepting the ethylene diamine which is expressed as percent by weight of the nitromethane.

23. A foamable fluid explosive composition, comprising

| | Weight Percent |
|---|---|
| nitromethane | 78.0 |
| polyethoxylated stearyl alcohol | 3.6 |
| octadecanol | 2.3 |
| nitrocellulose | 1.4 |
| aluminum powder | 9.2 |
| propane (liquified) | 5.5 |

-continued

| | Weight Percent |
|---|---|
| | 100.0 |

wherein the amounts of ingredients are expressed as percent by weight of the composition.

24. A foamable-fluid explosive composition, comprising

| | Weight Percent |
|---|---|
| nitromethane | 91.0 |
| polyethoxylated stearyl alcohol | 4.0 |
| fumed silica | 3.5 |
| propane (liquified) | 1.5 |
| | 100.0 |

wherein the amounts of ingredients are expressed as percent by weight of the composition.

* * * * *